United States Patent [19]

Watanabe et al.

[11] Patent Number: 4,601,431

[45] Date of Patent: Jul. 22, 1986

[54] TRAVELING MAGNETIC FIELD TYPE CRUSHER

[75] Inventors: Yasuo Watanabe; Takeo Takahashi; Keiji Haga, all of Kanagawa, Japan

[73] Assignee: Fuji Electric Company, Ltd., Japan

[21] Appl. No.: 417,204

[22] Filed: Sep. 13, 1982

[51] Int. Cl.[4] ..... B02C 17/18

[52] U.S. Cl. ..... 241/172; 51/7; 241/284

[58] Field of Search ..... 252/62.51; 523/300; 51/7, 163.1; 366/341, 349, 118, 273, 274; 241/284, 1, 301, 184, 170, 172

[56] References Cited

U.S. PATENT DOCUMENTS

| | | | |
|---|---|---|---|
| 2,852,586 | 9/1958 | Steele | 241/1 X |
| 2,880,554 | 4/1959 | Simjian | 51/7 |
| 3,848,363 | 11/1974 | Lovness et al. | 51/7 |

FOREIGN PATENT DOCUMENTS

| | | | |
|---|---|---|---|
| 5991 | 2/1976 | Japan . | |
| 564950 | 7/1977 | U.S.S.R. | 51/7 |
| 638370 | 12/1978 | U.S.S.R. | 241/1 |

*Primary Examiner*—Mark Rosenbaum

*Attorney, Agent, or Firm*—Brumbaugh, Graves, Donohue & Raymond

[57] ABSTRACT

An improved traveling magnetic field-type apparatus for crushing, mixing, polishing, deburring and the like is provided, comprising a container containing working substances and a quantity of material to be crushed operatively arranged between first and second traveling magnetic field generators. The generators are selectively shiftable between a first orientation and a second orientation, in which like polarity and dissimilar polarities face each other across the container. The field generators may be circular and concentrically arranged, or in the shape of a circular arc. Diaphragms also may be provided in the container to distribute more uniformly the working substances and the material to be crushed. It has been determined that the working substances are more readily magnetized, resulting in a higher magnetic torque, if they are relatively longer in the axial direction than in the cross sectional direction. Weighted portions may also be provided at each axial end of the pieces of the working substance to further concentrate the mass at each axial end, and thereby further increase the torque.

12 Claims, 25 Drawing Figures

PRIOR ART

TRAVELING MAGNETIC FIELD TYPE CRUSHER

BACKGROUND OF THE INVENTION

This invention relates to apparatus for crushing granular substances using a traveling magnetic field.

Heretofore, ball mills, vibration mills, jet mills and the like have been employed for crushing granular materials. The known ball mill crushers comprise a cylinder which is turned on its horizontal axis and which house, e.g., steel balls which, when the cylinder is turned about its axis, move upwardly in the cylinder and thereafter tumble down onto the base of the cylinder. Strong shock motion and frictional action are thus applied to the material to be crushed when the steel balls are falling, forcing the granular material against the inside wall of the cylinder and, thereby, crushing it. However, when the steel balls are falling, energy is dissipated due to the collision of the steel balls with each other. Thus, the total energy available is not utilized for crushing purposes. Consequently, the power employed to lift the steel balls is not effectively utilized. In addition, the ball mill has a counterbalancing disadvantage in allowing the motive power to be consumed by the energy loss incurred during the transmission of a driving force from a driving apparatus through a driving gear to turn the cylinder, as well as loss in the bearings when the cylinder is made to turn.

In known vibration mills, energy is wasted by the steel balls colliding with each other as in a ball mill. Further disadvantages include noise and vibration caused by vibrating a container containing granular materials in tens of cycles.

With respect to the known jet mills, (also known as fluid energy mills) these are designed to accelerate fine grains of granular material, by means of a jet stream obtained by jetting air or heated steam (pressurized up to several times atmospheric pressure) from a nozzle several millimeters in diameter, so that the fine grains are crushed when they collide with each other and with the interior walls of the device. However, these jet mills are unable to crush grains several millimeters in diameter down to pieces on the order of a micron, and are mainly employed to crush extra fine grains less than a few microns across (the crushing efficiency being extremely worsened when used for crushing larger diameter grains). Grain diameters suitable for crushing in the case of the jet mill are normally less than 500 $\mu$m, which disadvantageously requires preliminary crushing. Another disadvantage is that its crushing capability is limited to several tens of microns even if particles of 500 $\mu$m in diameter may have been crushed. Still another disadvantage is the necessity of re-crushing the above grains to pieces less than 1 $\mu$m in diameter.

In place of these above-described known crushers, which result in energy loss and necessitate a long period of time when crushing granular materials, an apparatus used to crush granular materials by the utilization of a magnetic field, shown in FIG. 1, is known from Japanese Patent Announcement No. 51-5991. Referring to FIG. 1, there is shown a reactor 1 enclosing pieces of ferromagnetic material 2, a guide bush 3 for the reactor 1, a rotating magnetic field generator 4, and an assembly 5 comprising a crank and a connecting rod. In this known apparatus, the assembly 5 is turned in the direction of the arrow to impart an alternating motion to the reactor 1, which contains the mixture of granular materials and the pieces of ferromagnetic material 2, against the rotating magnetic field generator 4. The pieces of ferromagnetic material 2 contained in the reactor 1 rotate in a direction parallel to the rotating magnetic field produced by the rotating magnetic field generator 4. Thus, the pieces of ferromagnetic material 2 start rotating rapidly, causing the granular materials to be crushed.

Because the pieces of ferromagnetic material 2 are attracted by the rotating magnetic field and stay within the zone affected by the field despite the alternating motion of the reactor 1, the granular material contained in the reactor 1, which is longer than the rotating magnetic field generator 4, can be crushed, thus making it possible to process a larger amount of the granular material.

However, the strength of the magnetic field is weakened as its distance from the guide bush 3 increases. The crushing strength also is reduced because the motion of the pieces of ferromagnetic material 2 gradually slows. Therefore, it is impossible to construct and operate a large-sized apparatus of this type, the reason being that the diameter of a reactor 1 for such an apparatus would have to be relatively large, which in turn would result in a weak magnetic field in the central portion of the reactor. As a result, grains are not effectively crushed in places other than the area close to the rotating magnetic field generator 4, or the portion close to the internal circumferential surface of the reactor 1. Thus, some grains may be left uncrushed. Furthermore, the rotating magnetic field is unidirectional, and renders uniform the movement of the pieces of ferromagnetic material. In this case, the disadvantage is that the movement of the pieces of ferromagnetic material is not sufficiently effective to obtain a satisfactory crushing effect.

SUMMARY OF THE INVENTION

In light of the aforementioned problems, it is an object of the present invention to eliminate disadvantageous characteristics of the apparatus of the prior art, and to offer an apparatus in which the energy inputted for crushing purposes is effectively utilized.

Another object of the present invention is to offer an apparatus in which materials contained in a container are crushed in any portion of the container.

Still another object of the present invention is to offer a compact apparatus which makes it possible to obtain extra fine grains in a shorter crushing period with reduced vibration and noise.

Yet another object of the invention is to offer pieces of working substance to be placed in the container for crushing, mixing or stirring the material to be processed, the shapes of which are based upon the analysis of the magnetic field between the two generators, the magnetic torque acting on the pieces of working substance, and other considerations resulting from the motions imparted to the material to be processed by the pieces of working substance.

These and other objects, as will become apparent, are obtained by providing an apparatus in which oppositely arranged traveling magnetic field generators sandwich a container having the material to be crushed therein. The magnetic fields are oppositely directed to create violent collisions of the material to be crushed with working substances in the container, and with the inner walls of the container.

In accordance with one embodiment of the invention, two concentrically arranged traveling magnetic field generators have disposed therebetween a circular container into which a quantity of ferromagnetic working substances and the material to be crushed are placed. In one condition, two poles of the oppositely arranged generators are arranged so that different poles (N-S) face each other. After a predetermined time, determined by the frequency of the power supply, the poles are shifted so that like poles (N-N or S-S) face each other, creating a magnetic passage to the next adjacent pole of each field generator. The variation of the magnetic fields in this manner results in a complicated random motion of the ferromagnetic working substances, creating the above-mentioned violent collisions, and resulting in improved crushing capability.

Alternative embodiments of the invention comprise oppositely arranged generators which are non-circular, and wherein one or both generators are arc-shaped. The pole pitches of the traveling magnetic field generators also may be varied, which similarly results in complicated motion of the working substances. In both the circular and arc-shaped embodiments, diaphragms may be provided in the container at uniform intervals to distribute more evenly the material to be crushed, therefore improving both the efficiency and the capacity of the crushers of the present invention. In accordance with still other embodiments, conductive grains may be used as the working substance.

The pieces of the working substance should preferably be rod- or bar-shaped, and may be carbon steel, for example. They may comprise any material other than that, however, provided that the material used has adequate hardness, anti-wearing and anti-tearing properties. A non-magnetic conductive material such as copper or aluminum can be used as the working substance for mixing a liquid or a powdery material.

The size of a piece of the working substances may be determined in reference to the sizes of the pieces of material to be crushed, and preferably should not be smaller than the sizes of these materials. For example, the working substance can be 2 $\phi$mm $\times$ 15 mm if carbon steel is used for crushing a material of particle size of several mm$\phi$ into particles of about 10 micron $\phi$.

In accordance with the various embodiments of the present invention, therefore, oppositely arranged traveling magnetic field generators having reversing magnetic directions permit the construction of crushers of relatively large size and high efficiency. An increase in the amount of granular material to be processed may be accomplished by providing diaphragms inside the container. The crushers may be made more compact with traveling magnetic field generators in the form of a circular arc or a flat plate, and the crushing efficiency improved by allowing only one of the pole pitches of the traveling magnetic field generators to become variable. Because the crusher according to the present invention requires no movable portions, in contrast to the ball mill, vibration mill, and so on, improved crushers which are free from vibration and noise can be offered.

BRIEF DESCRIPTION OF THE DRAWINGS

For a better understanding of the present invention, the scope of which will be pointed out in the appended claims, reference may be had to the following detailed description of exemplary embodiments, taken in conjunction with the accompanying drawings, wherein:

DESCRIPTION OF EXEMPLARY EMBODIMENTS

Figure 1:
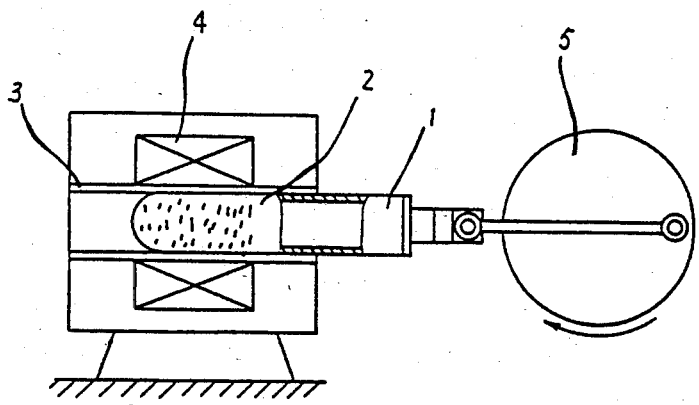
FIG. 1 is a transverse sectional view of an apparatus of the prior art using a rotating magnetic field.
Figure 2:
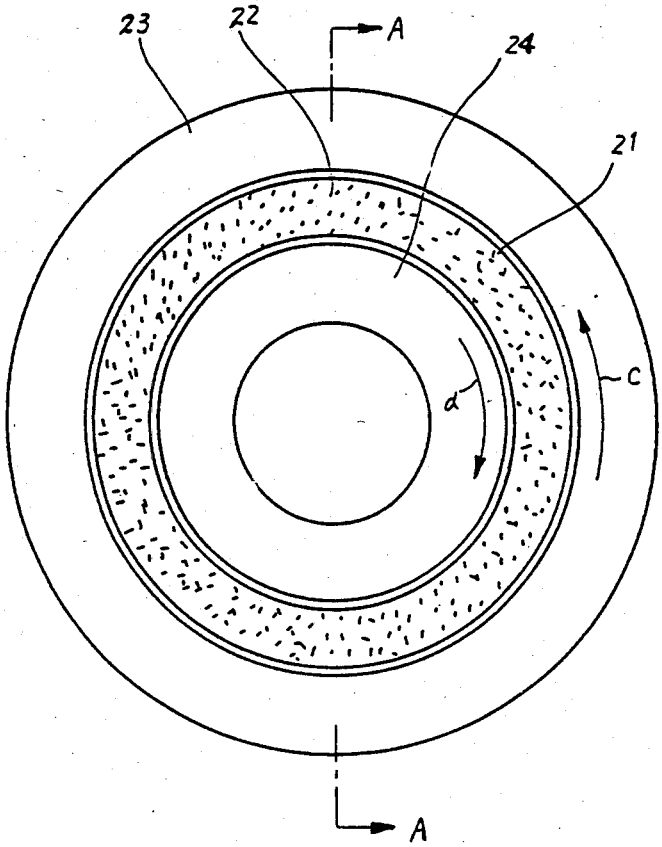
FIGS. 2 and 3 illustrate an example of a traveling magnetic field type crusher according to the present invention, FIG. 2 being a top view of the crusher, FIG. 3 being a sectional view taken along the line A—A in FIG. 2.
Figure 3:
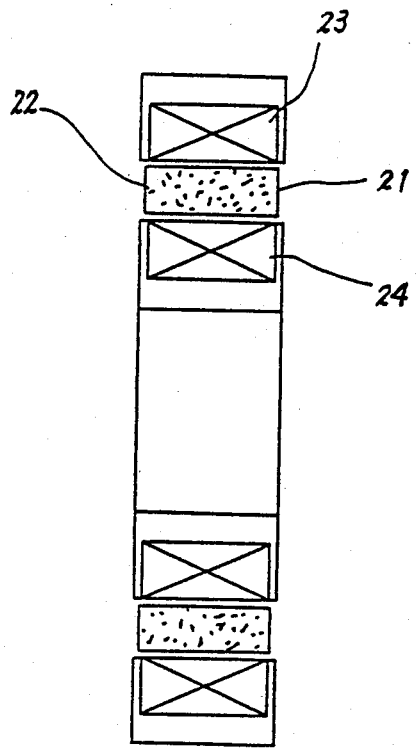

With reference to the drawings, and in particular to FIGS. 2 and 3, there is shown a container 21 made of a non-magnetic substance arranged between traveling magnetic field generators 23, 24 which are circular and arranged concentrically. The field generators 23, 24 are so constructed that the container 21 is affected by the magnetic field action of each generator 23, 24. A proper number of pieces of ferromagnetic working substance 22, together with granular material to be crushed, are contained in the non-magnetic container 21. The traveling magnetic fields of the traveling magnetic field generators 23, 24, formed with three-phase alternating current windings, are so arranged that both of the magnetic fields are oppositely directed, as shown by arrows c, d.

By allowing the traveling magnetic field generators 23, 24 to face each other, and by providing a predetermined space between them, the motion of the working substances 22 in the traveling magnetic fields is made complex and active.

Figure 4:
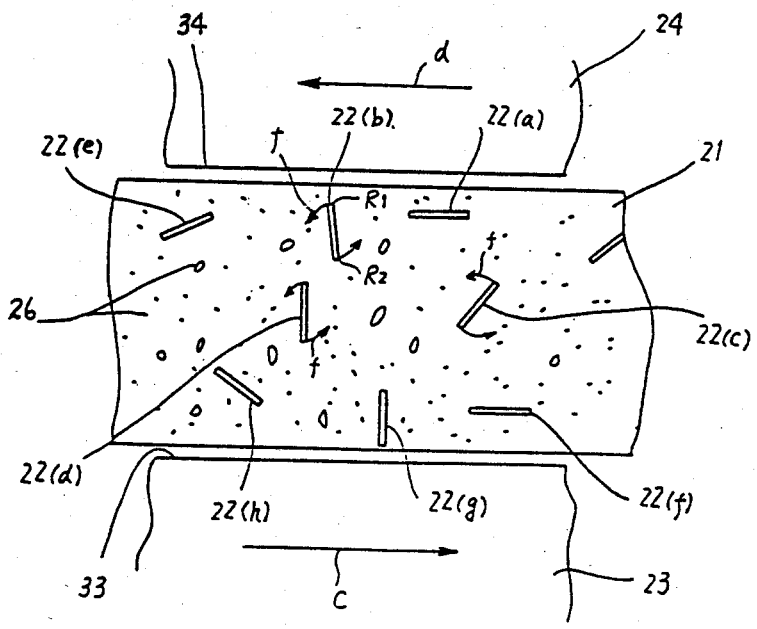
FIGS. 4, 5(*a*) and 5(*b*) each are operational diagrams.

With reference to FIG. 4, the working substances 22 in the container 21 sandwiched between the traveling magnetic field generators 23, 24 are affected in a slightly different way by the magnetic fields, depending on the locations and positions of the substances. For instance, a working substance 22*a* which is close to the traveling magnetic field generator 24, and located in parallel with the surface 34 of an iron core, is supplied with a driving force in the direction (shown by the arrow d) to which the traveling magnetic field moves, and is also attracted by the surface 34 of the iron core of the traveling magnetic field generator 24, so that the substance violently collides with the surface of the container 21. The granular material is thereby crushed at the time of such collision.

The working substance 22*b*, located at a right angle to the surface 34 of the iron core of the traveling magnetic field generator 24, is forced to move in the direction shown by the arrow d under the influence of the traveling magnetic field. However, because the force that the working substance receives at points $R_1$ and $R_2$, which are close to and away from the surface of the iron core, respectively, is different in such a way that the point $R_1$ is more affected by that force than the point $R_2$ (because the magnetic flux density decreases as the distance from the surface of the iron core increases), the working substance 22*b* makes a rotary motion (with the center of its mass as the center of its rotation). This rotary motion has been conspicuously recognized in a photographic playback.

Working substances 22*c*, 22*d*, located roughly equidistant of the traveling magnetic field generators 23, 24, are equally affected by the traveling magnetic fields on both sides, and turn in the direction shown by an arrow f. Other working substances 22*f*, 22*g*, 22*h* also move in the same manner as mentioned above. These working substances collide with each other and with the inside wall of the container 21 and as a whole move at random, so that the granular material 26 is crushed into fine pieces within an extremely short time.

FIGS. 5(*a*) and 5(*b*) illustrate the aspects of variations of the magnetic field, and are segmentary views of a traveling magnetic field generator (illustrating only the traveling magnetic field generator). Each of the traveling magnetic fields moves in the directions indicated by the arrows c, d, (which illustrate a certain instantaneous condition). As to the polarity of the traveling magnetic field generator under the conditions shown in FIG. 5(*a*), different poles N-S face each other, magnetic flux being distributed from N to S as shown. After a certain predetermined time (time being determined by the frequency of the power supply), a state shown in FIG. 5(*b*) is obtained, wherein the polarity of the traveling magnetic field generator is such that the same poles N-N or S-S are facing each other. In this state, the magnetic flux from each of the traveling magnetic field generators forms a magnetic passage to the next pole of each field.

This change of the magnetic field occurs a number of times proportionate to the frequency of the power supply. As a result of arranging the magnetic fields on both sides, as compared with the case of using a shifting magnetic field generator on either side, the variation of the magnetic field becomes extremely complicated, and the electromagnetic force affecting the working substances existing in the magnetic field changes in various ways. The crushing capability of the apparatus of the present invention is thus improved because of the complicated random motion of the working substances.

Figure 6:
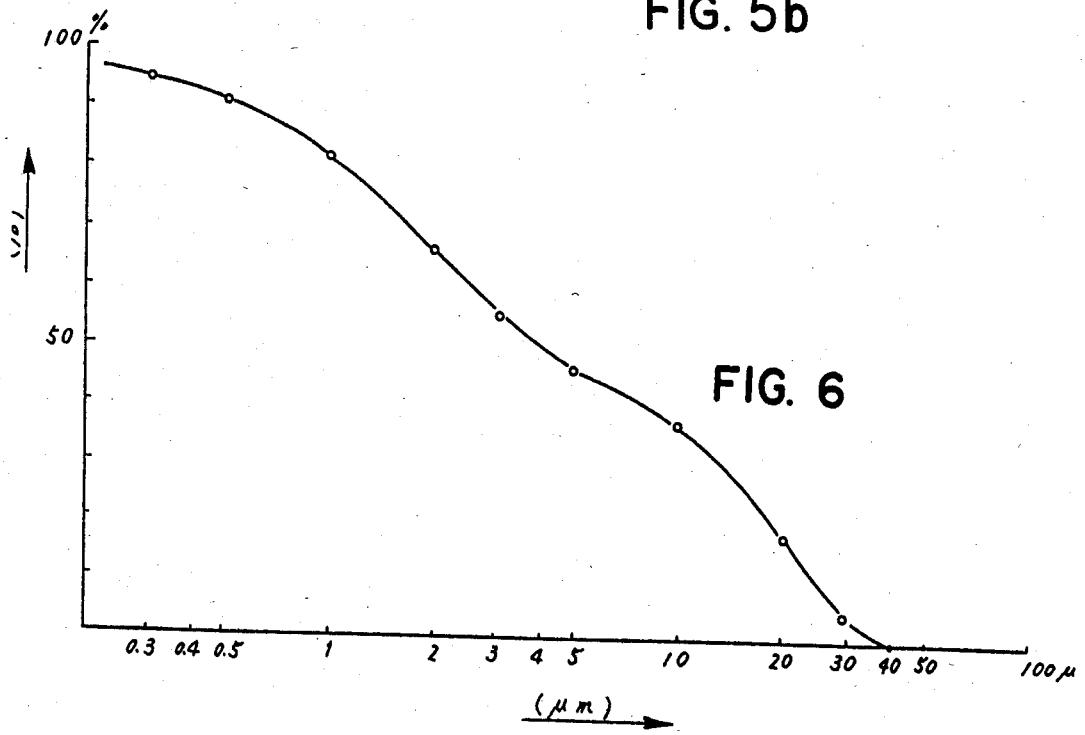
FIG. 6 is a grain distribution chart showing the results of a crushing operation performed in accordance with the present invention.

FIG. 6 shows an example of data obtained when the above crushing method was employed. Marble as granular material 1.19–1.41 mm in grain size was crushed for five minutes. The marble was crushed to fine pieces less than 40 μm in diameter, and 50% of the pieces were less than 4 μm in diameter. It will be appreciated that it would be possible to obtain extra fine pieces less than 1 μm if the time for crushing is made longer. In comparison, in the case of a ball mill of the prior art, the time required will be 20–30 hours to achieve comparable results, and for a vibration mill, 1–2 hours. Multi-stage crushing processes will become necessary in the case of a jet mill.

As mentioned above, facing and oppositely directed shifting magnetic fields greatly increase the performance of the apparatus of the present invention, while the location of a shifting magnetic field generator in the inner portion makes it possible to construct larger crushers with a correspondingly larger processing capacity. This in turn increases the applications for crushers of this type.

Although the embodiment of FIGS. 2 and 3 refers to facing shifting magnetic field generators, either one may be constructed of a material having low magnetic resistance (for instance, an iron core of crude steel sheet). When the inside shifting magnetic field generator is replaced with only an iron core, for instance, magnetic resistance is largely decreased, and the magnetomotive force of the outside shifting magnetic field generator can, accordingly, be reduced. Particularly, working substances can be held in a magnetic flux density effective in crushing.

Although mention has been made of the utilization of a three-phase a.c. winding as a shifting magnetic field generator, use of a cylinder supplied with a permanent magnet and the rotation of the cylinder yield the same effect.

Figure 7:
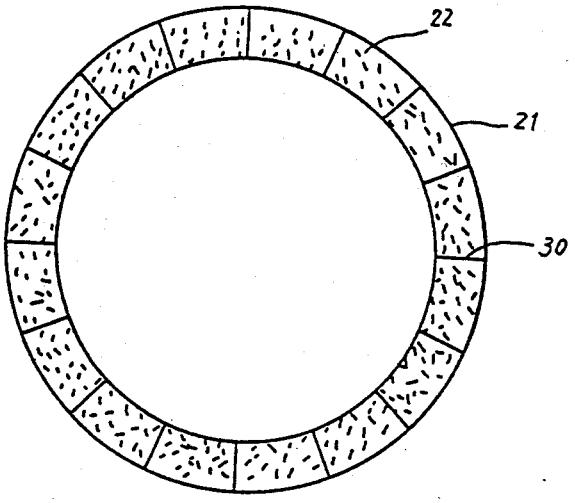
FIG. 7 is a side view of a portion of an alternative embodiment of the present invention.

FIG. 7 illustrates a second embodiment of the present invention comprising a container having a different shape. The container 21 is different from that of the embodiment of FIG. 2 in that a suitable number of diaphragms 30 have been added to the container 21. By the addition of the diaphragms 30, not only the number of times the working substances 22 in the shifting magnetic field collide with the diaphragms 30, but also the number of times they collide with the inside wall of the container 21 increases, so that the motion of the working substances 22 becomes even more random than is the case with the embodiment of FIG. 2, yielding increased crushing effects and improved efficiency. In addition, the installation of the diaphragms 30 helps improve the strength and hardness of the container 21, making it possible to reduce the thickness of material used to form the container, thereby decreasing its weight and making the crusher less costly.

The diaphragms 30 also serve to increase the amount of granular material which may be processed. Without the diaphragms (as shown in FIG. 2), granular material is apt to concentrate in the lower portion of the container because of its own weight, and crushing is carried out on the lower side of the container. As shown in FIG. 7, the diaphragms 30 help to maintain the granular material uniformly about the circumference of the circular container.

Figure 8:
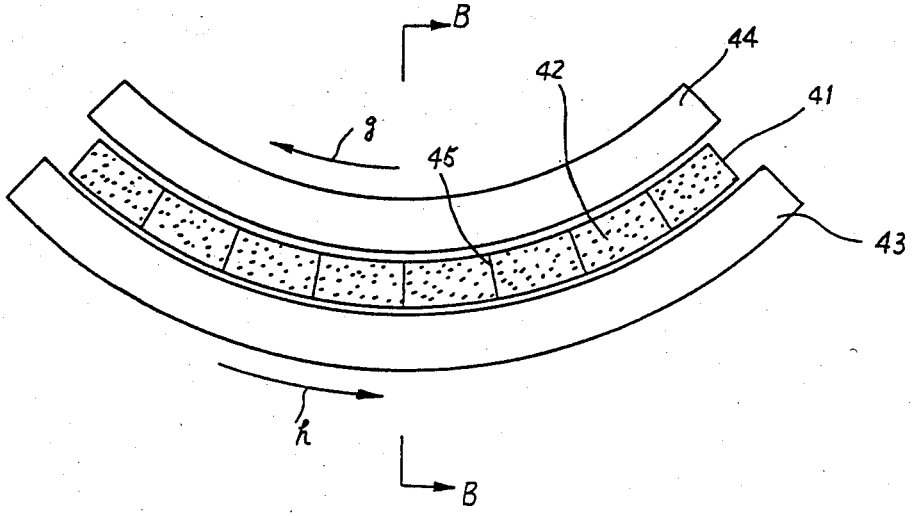
FIGS. 8 and 9 illustrate another alternative embodiment of the present invention, FIG. 8 being a top view, FIG. 9 being a sectional view along the line B—B in FIG. 8.
Figure 9:
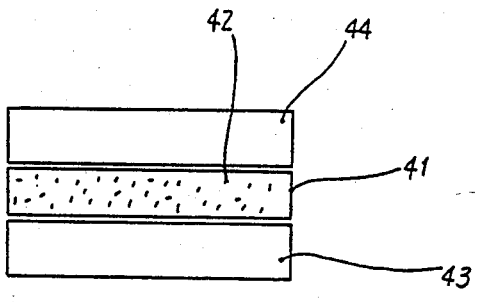

FIGS. 8 and 9 refer to a third embodiment of the present invention which is different from the embodiment of FIG. 2 in that the shifting magnetic field generators 43, 44 and the container 41 are arranged in the form of a circular arc, not a circle. This arrangement eliminates an unnecessary space in the central portion, as in the case of the circular embodiments of FIG. 2 and FIG. 7. The crusher is thus made more compact. Diaphragms 45 also are provided in accordance with this embodiment. In the case of the circular arc of this embodiment, a cold punched stator of a large electric machine may be appropriate. This can result in an anchor without an iron core being necessary, thus offering an inexpensive crusher. Although a circular arc type is shown in the drawing, use of a flat plate type shifting magnetic field generator will not naturally alter the effects obtained.

Figure 10:
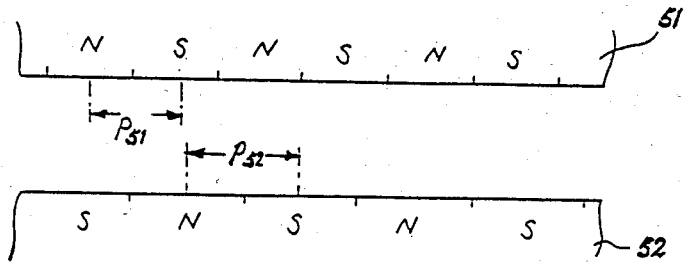
FIG. 10 is an enlarged view of a portion of still another embodiment of the present invention.

FIG. 10 illustrates a fourth embodiment of the present invention, the difference from the embodiment shown in FIG. 2 being in the pole pitches of the shifting magnetic field generators 51, 52. The speed of a shifting magnetic field is represented by $$V=2\ p\ f,$$

where p=pole pitch; f=the frequency of a power supply; and v=synchronous speed. Therefore, when the pole pitches of the shifting magnetic field generators 51, 52 are assumed $p_{51}$, $p_{52}$, each of the synchronous speeds is $$v_{51}=2\ p_{51}\ f;\ v_{52}=2\ p_{52}\ f.$$

As a result, the motion of working substances given by each of the shifting magnetic field generators is affected by the synchronous speeds, resulting in a complicated motion.

Figure 5A:
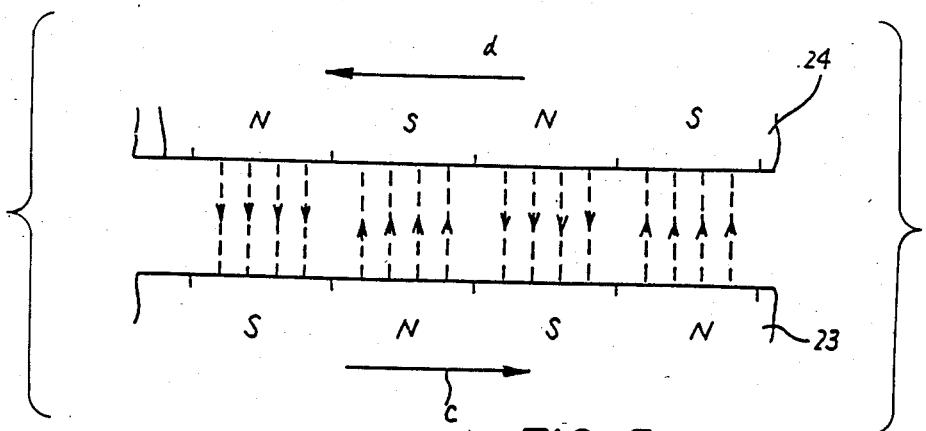
Figure 5B:
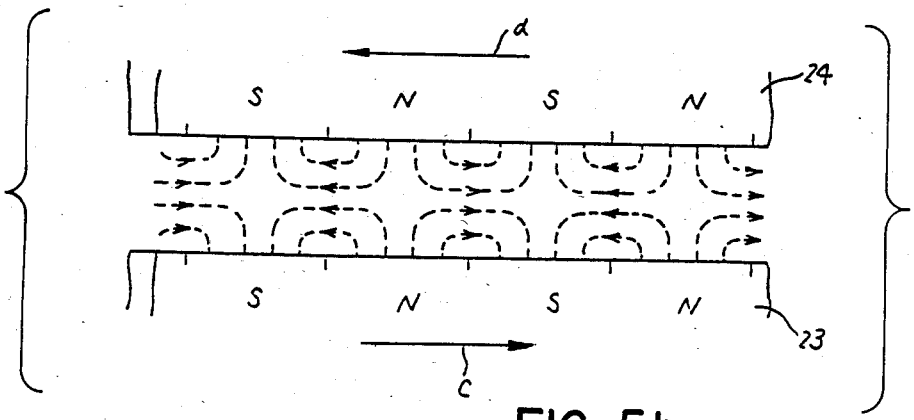

Because the variation of the magnetic field apparently becomes much more complicated than as illustrated in FIGS. 5*a* and 5*b*, the number of times granular material is crushed increases, thus further improving crushing efficiency.

In addition, the same effect is obtained when the strength of either magnetic field is changed. Electromagnetic driving force applied to working substances in a magnetic field in the direction of a shifting magnetic field is generally stated as $$f = K_1 \cdot K_2 \frac{f B^2}{p}$$

where f=electromagnetic driving force affecting working substances; $K_1$=a constant determined by the material and dimensions of the working substances; $K_2$=a proportional constant; f=the frequency of a supply; B=the magnetic flux density interlinking with working substance; and p=a pole pitch of the shifting magnetic field generator. Consequently, the alternation of the strength of the magnetic field generated by one of the facing shifting magnetic field generators (for instance, when the strength of the magnetic filed of the shifting magnetic field generator 23 is increased as shown in FIG. 4), changes the motion of working substances placed under the influence of each magnetic field and further complicates the motion of the working substances. This results in the improved crushing effects.

Until now, working substances 22, 42 have been described as pieces of ferromagnetic material, but it will be appreciated by those skilled in the art that, when the above-mentioned pieces are replaced with pieces of conductive material or non-magnetic conductive materials, the same effects can be obtained because of the electro-magnetic action.

The following is an examble of the present invention, wherein pieces of conductive material are used as working susbtances, the construction of a crusher being slightly modified in accordance with a fifth embodiment of the present invention.

Figure 11:
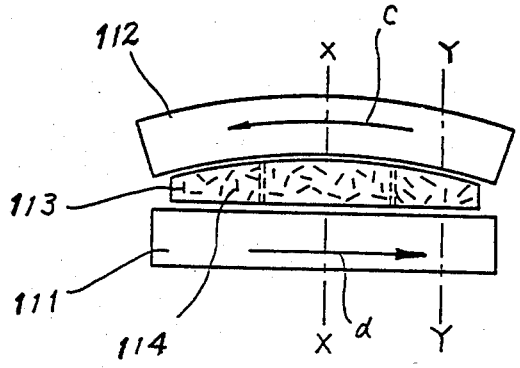
FIG. 11 is a schematic illustration of a portion of a further alternative embodiment of the present invention.

With reference to FIG. 11, a flat plate type traveling magnetic field generator 111 is arranged on the lower side, while a circular arc type traveling magnetic field generator 112 is arranged on the upper side. A container 113 containing pieces of conductive material 114 is arranged between these traveling magnetic field generators 111, 112. The moving direction c, d of the traveling magnetic fields of the traveling magnetic field generators 111, 112 are oppositely directed. Because the traveling magnetic field generators 111, 112 are oppositely arranged, and the moving directions of the traveling magnetic fields are oppositely directed, the action of the magnetic field of each traveling magnetic field generator 111, 112 is effectively imparted to the pieces of conductive material 114 in the container 113.

Additionally, because the traveling magnetic field generator 112 is a circular arc, the strength of the magnetic fields in a space between the traveling magnetic field generators 111, 112 is different depending upon relative location. For instance, the strength of the magnetic field in the sectional portion X—X close to the central portion of the traveling magnetic field generators 111, 112, and that in the sectional portion Y—Y close to the end portion, are different in the same way that there is a difference in distance from the traveling magnetic field generators. When the strength of the magnetic fields in the sectional portions X—X and Y—Y is assumed $H_{(X-X)}$, $H_{(Y-Y)}$, respectively, there is a relation of $H_{(X-X)}<H_{(Y-Y)}$. Therefore, electro-magnetic force in proportion to the strength of the magnetic field is applied to the pieces of conductive material 114 existing in each magnetic field, so that different crushing force is generated.

Because the strength of the magnetic field in the sectional portion Y—Y is stronger than that in the sectional portion X—X, the motion of the pieces of conductive material is active, and powerful crushing action is carried out in the former. Making the strength of the magnetic fields different in this way, while providing diaphragms (shown by dotted lines in the container 113), for instance, makes it possible to crush hard granular material on the end positions of the container and to crush soft granular material in the central portion.

Figure 12:
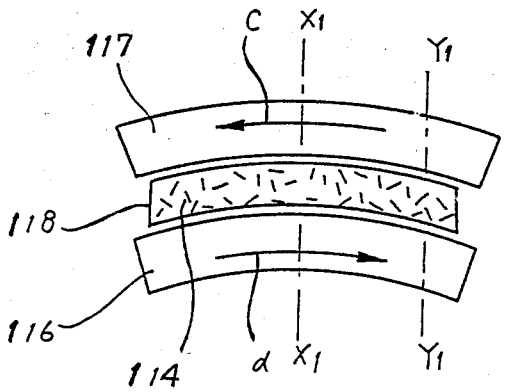
FIG. 12 is a sectional view of still another alternative embodiment of the present invention.

FIG. 12 shows a sixth embodiment of the present invention, the difference from FIG. 11 including a lower traveling magnetic field generator 116 in the form of a convex circular arc and an upper traveling magnetic field generator 117 provided with an iron core of which an inside circular arc has a smaller diameter than that of the lower traveling magnetic field generator. A container 118 is made in conformity with the arc of each traveling magnetic field generator. As a result, there is produced a difference in the strength of magnetic fields between a sectional portion $X_1$—$X_1$ and a sectional portion $Y_1$—$Y_1$, the sectional portion $Y_1$—$Y_1$ having a stronger magnetic field. In addition, as to the bottom of the container, the sectional portion $Y_1$—$Y_1$ is at a lower level than the sectional portion $X_1$—$X_1$, so that crushing material with a large specific gravity and heavy material move toward the sectional portion $Y_1$—$Y_1$. Therefore, material with large specific gravity and heavy material can be thoroughly crushed in a portion close to the sectional portion $Y_1$—$Y_1$ where the strength of the magnetic field is large.

According to some embodiments the present invention, the distance between the oppositely arranged traveling magnetic field generators is non-uniform. For instance, one (or both) of the traveling magnetic field generators is (or are) constructed in the form of a circular arc, so that the distribution of the strength of magnetic fields is made uneven. Consequently, the energy of the traveling magnetic field generator can be utilized effectively. Therefore, material in a container can be uniformly crushed. By providing strong and weak magnetic fields in different portions of the container, the motion of the pieces of conductive material is further complicated as compared with those having uniform strength of magnetic fields, thus improving crushing efficiency in accordance with the invention.

Figure 13:
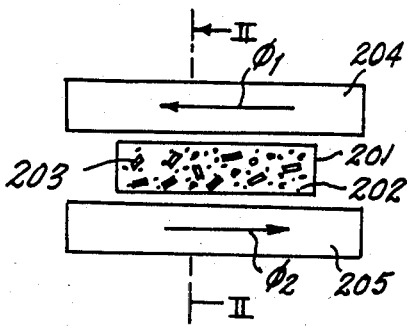
FIGS. 13 and 14 are simplified examples of the apparatus of the present invention.
Figure 14:
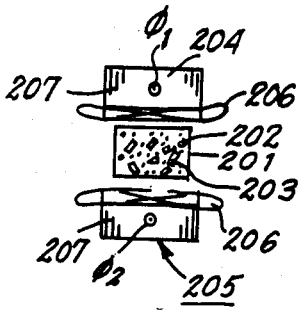

Referring now to FIGS. 13 and 14, which are illustrative of the typical examples of the traveling field type processing apparatus according to the invention (collectively representing crushers and mixers), there is shown a processing container 201 for containing a number of pieces of ferromagnetic working substance 203, together with, for instance, material to be processed 202. Upper and lower traveling field generators 204, 205 sandwich the container 201, and their traveling fields $\phi 1$, $\phi 2$, respectively, are oppositely directed to each other. The traveling field generators 204, 205 are well known as so-called linear motors. As in the case of a rotary electric machine, three-phase a.c. winding 206, for instance, is provided in coil slots on the pole-face side of an iron core 207, and the linear motors 204, 205 generate traveling fields $\phi 1$, $\phi 2$ on receiving power from a power supply.

Magnetic force gathered by magnetizing current, eddy current and the like acts on working pieces 203 in the traveling fields 1, 2 due to a reciprocal action, as a result of which the working pieces 203 produce random motions in the container 201 under the influence of translational force, surfacing force and centrifugal torque in the directions of the traveling fields, as well as due to the motions caused by the collision of the working pieces with one another and with the interior walls of the container. Material to be processed 202 is crushed, mixed and stirred by the random motions of the working pieces. The collision of the working pieces 203 with the material to be processed 202 mainly advances the crushing process (whereas the mixing and stirring processes are advanced by the flow of the material 202 in company with the motion of the working pieces 203). Accordingly, in order to carry out these processes efficiently, it is desirable to increase the driving torque of the working pieces based on a reciprocal action with the traveling fields, and to allow the working pieces 203 to move in a complicated way so that the working pieces 203 are dispersed throughout the whole space of the container 201 and act effectively on the material to be processed 202.

Tests conducted using working pieces 203 having various shapes, including steel balls, dice, cylinders, square pillars and so on, indicate that the motions and the processing capacity of working pieces considerably varies with their shape. For instance, steel balls move slowly and slide down along the interior walls of the container. Those having other shapes form in a line along the wall of the container in an immobile form, or otherwise demonstrate a low processing capacity, and a low capacity for crushing material in comparison with supplied power. From an overall point of view, therefore, it has been desirable to determine the shape for a working piece which satisfies various functional requirements and which is suitable for use in the aforementioned processing apparatus.

Figure 15:
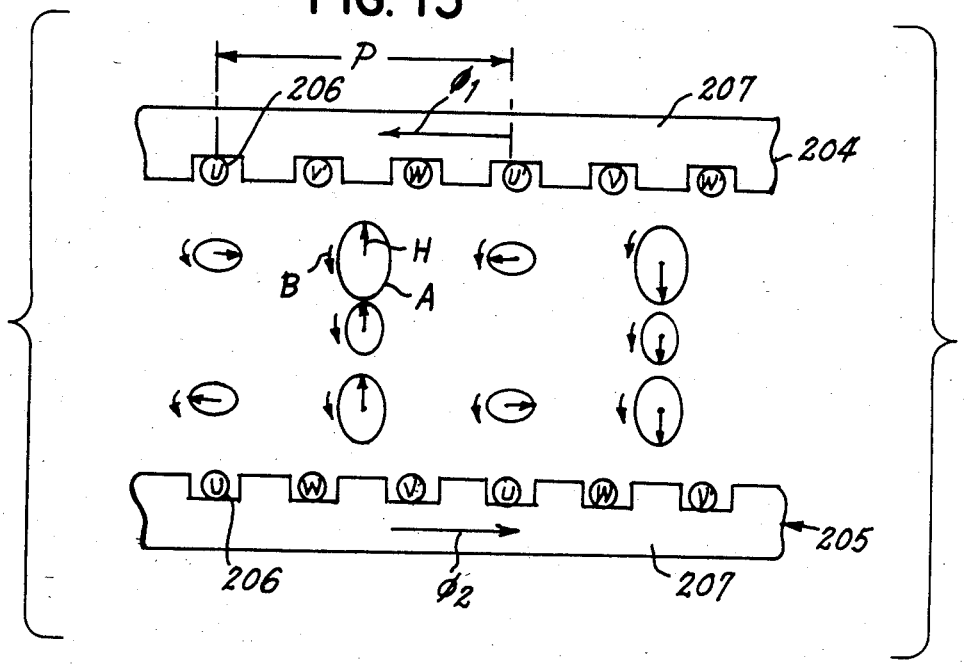
FIG. 15 is a magnetic field distribution chart.

FIG. 15 is a magnetic field distribution chart of the active space between the linear motors 204, 205 (of FIG. 13) drawn according to the analyzed results of the magnetic field. In FIG. 15, an iron core 207 is provided with U, V, W phase, or three-phase a.c. winding in the form of, for instance, wave winding in the following order: U-V'-W-U'-V-W'-U in the right direction for the linear motor 204; and U-W'-V-U'-W-V'-U in the right direction for the linear motor 205. U and U', V and V', and W and W' represent the positive and negative directions of coil conductors wound on the coil slots. A space P between conductors U–U' is set at a pole pitch. Although the illustrative drawing shows that the upper and lower U-phase windings are allowed to face each other at the same position, the magnetic field characteristics are not changed if windings in different phases are made to face each other.

FIG. 15 indicates that, when the current flowing in the U-phase winding of the linear motors 204, 205 is the maximum value (the winding current should have a sine wave), an arrow H at each place represents the vector of the magnetic field at that place. An ellipse A surrounding the vector H of the magnetic field illustrates the locus of the vector H of the magnetic field, accompanying the change of the winding current to the extent of one cycle, and an arrow B points the direction of the rotating vector H of the magnetic field.

As illustrated in the magnetic field distribution chart of FIG. 15, in the magnetic field of the space affected by each of the traveling fields $\phi 1$, $\phi 2$ of the linear motors 204, 205 the magnetic field at each place, excluding a particular one, may be regarded as a revolving magnetic field which, moment by moment, turns counterclockwise on each alteration of current because the traveling fields $\phi 1$ and $\phi 2$ interfere with each other. The pieces of working substance contained in the container are magnetized by the magnetic fields and motions are generated by magnetic force based on the reciprocal action. The observation of the states of the motion of the pieces of working substance through photographs taken by a high speed camera has confirmed that the pieces of working substance 203 surface from the inside wall of the container 201 and rotate in a free space; those located in the neighborhood of the surface of the iron cores of the linear motors 204, 205 move in the directions of the magnetic fields $\phi 1$, $\phi 2$ and run along the internal periphery of the container 201. This fact is naturally presumed from the magnetic field distribution in FIG. 15.

In addition, when material to be processed 202 together with pieces of working substance 203 are placed in the container 201, the material 202 is observed to collide with the rotating working pieces 203 violently, and is subsequently crushed during this process. When pieces of working substance 203 made of non-magnetic conductive materials, such as stainless steel and aluminum instead of magnetic materials are used, their motions are weaker than those of pieces of ferromagnetic material.

As has been made known by the results of these observations, translational force, surfacing force and rotating torque cause the rotation of the working pieces. The magnetic torque results from the polarization of the working pieces and eddy current, although the distribution of the latter is small. What mostly affects processing characteristics, for instance, for crushing purposes, is the magnetic torque used to rotate the working pieces 203 themselves.

Figure 16:
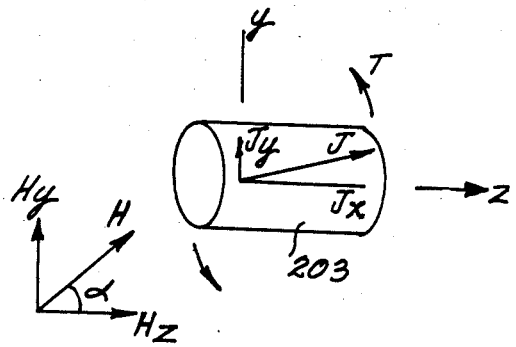
FIG. 16 is an enlarged view of a cylindrically-shaped test piece of working substance.

With reference to FIG. 16, cylindrical working pieces 203 were used as test pieces. When an external magnetic field H (i.e., rotating magnetic fields at each place as shown in FIG. 15) is applied to the working piece 203 in a direction at a certain angle to the x-y coordinates as illustrated, the working piece 203 is magnetized as indicated by J, whereby magnetic torque T and the external magnetic field H act on the working piece 203. The torque T in this case is the vector product of the external magnetic field H and magnetic moment M produced by the magnetization of the working piece 203. Because the magnetization J is magnetic moment per unit area, torque T is given by $T=v.J\times H=v(Jx.Hx-Jy.Hy)$, where v=the volume of the working piece. On the other hand, magnetization Jx, Jy is determined by the components Hx, Hy in the directions of the x, y axes of the external magnetic field H, and each of the demagnetizing coefficients in the directions of the x, y axes of the working pieces 203. In addition, the demagnetizing coefficient is, as is well known, changed by a permeance coefficient, or the shape of the working piece 203. Given that the demagnetizing coefficient=D, whereas the permeance coefficient=P, the relation between the former and latter is expressed by:

$$D = \frac{1}{1+P}$$

Each of the demagnetizing coefficients in the directions of x, y axes, therefore, is given as $$Dx = \frac{1}{1+Px}\ ;\ Dy = \frac{1}{1+Py}\ .$$

Figure 17:
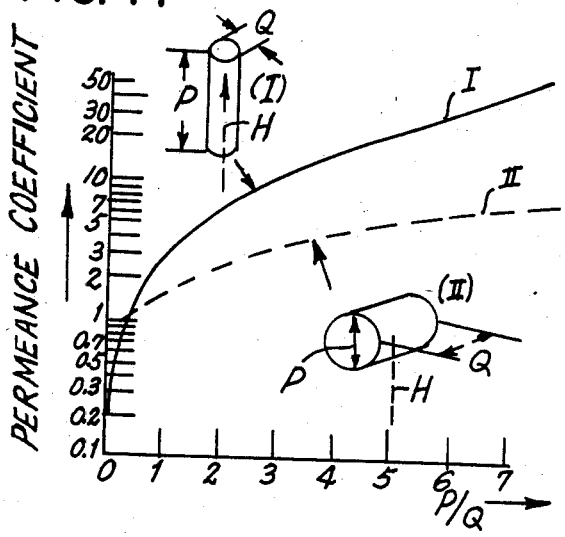
FIG. 17 is a graphic representation illustrative of the relation between the dimensional ratio and the permeance coefficient of the test piece of FIG. 16.

FIG. 17 is a graphic representation illustrative of the relationship between the dimensional ratio and the permeance coefficient when the same cylindrical substance as the working piece shown in FIG. 16 is used as a test piece. Of the characteristic lines I, II shown in FIG. 17, I refers to the permeance coefficient against each dimensional ratio when the test piece is magnetized in an axial direction, whereas II represents the coefficient when the test piece is magnetized in a diametric (i.e., transverse or cross sectional) direction. For the test pieces I, II, the dimension in the magnetizing direction for P and that at a right angle to the magnetizing direction for Q have been taken to indicate the P/Q dimensional ratio.

As illustrated in FIG. 17, when the diameter of working piece 203 is reduced by half in an axial direction, the dimensional ratio in the direction of the axis x becomes 2, whereas its permeance coefficient is 6. Consequently, the dimensional ratio and the permeance coefficient are, respectively, ½ and 1 in the direction of the y axis. By this is meant that the permeance coefficient in the axial direction of the cylinder is considerably greater. This trend can be further increased by increasing the length of the axis as compared to the diameter. In other words, a cylindrical working piece like the one shown in FIG. 16 is readily magnetized in the direction of its length as the working piece is made longer (the demagnetizing coefficient being small). As shown in FIG. 16, the magnetic torque which turns the working piece counterclockwise on its center of gravity, until the axis of the working piece conforms to the direction of the external magnetic field H, is also presumed to become greater.

When the processing operation in the processing apparatus shown in FIG. 13 is considered, the force of crushing the material 202 to be crushed due to the rotation of the working piece 203 on its center of gravity under the influence of the shifting fields $\phi 1$, $\phi 2$ becomes greater, by force of the moment of inertia, as the axial length of the working piece 203 is increased. Obviously, the more the mass of the working piece is concentrated at its ends, the greater the moment of inertia, and correspondingly, the larger its crushing force becomes. This effect may be utilized effectively for crushing, as well as mixing and stirring processes.

Based on the foregoing it is preferable according to the present invention to use a cylindrical substance as a working piece in such a shape that its length in an axial direction is relatively longer than its transverse width (i.e., cross section), with a greater permeance coefficient in an axial direction, in order to obtain a highly effective working piece.

Figure 18A:
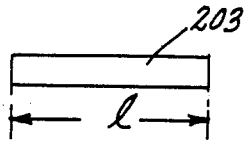
FIGS. 18(*a*) and 18(*b*) are diagrams illustrative of a piece of working substance in accordance with the present invention.
Figure 18B:
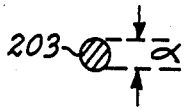
Figure 19A:
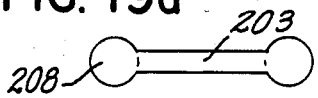
FIGS. 19*a*, 19*b*, 20*a*, and 20*b*, are further embodiments of pieces of working substance.
Figure 19B:
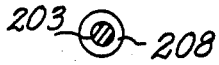
Figure 20A:
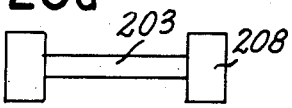
Figure 20B:
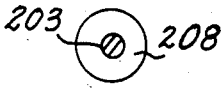

FIGS. 18(*a*) and 18(*b*) illustrate a working piece 203 having a length l in an axial direction substantially greater than its diameter d. The working piece 203 is in the form of a long thin cylinder. Such a shape (as has already been made clear in FIG. 17) has a greater permeance coefficient against magnetization in a longitudinal direction than against magnetization in a transverse direction. Therefore, such magnetization in the transverse direction can be mostly ignored, whereas the working piece is readily magnetized in a longitudinal direction and large magnetic torque operates through a reciprocal action with the external magnetic fields.

Figure 21:
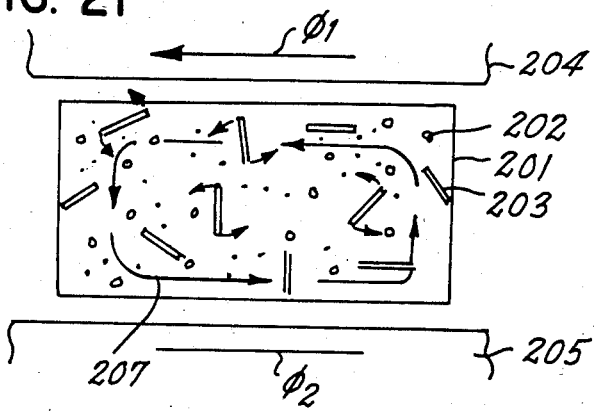
FIG. 21 is a further illustration of the movement of the pieces of working substance.

When cylindrical working pieces 203 are used to crush material 202, as shown in FIG. 21, the magnetic working pieces 203 generate, through a reciprocal action with a rotating magnetic field at each place in the magnetic field shown in FIG. 15, a torque proportional to the area of a hysteresis loop (as in the case of a hysteresis motor), rotate around their centers of gravity at high speed, and run about the internal periphery of the container 201 along shifting fields in the direction of an arrow 207. Accordingly, the crushing force imparted to the material to be crushed 202, when the working pieces collide with the material 202, is extremely large since the moment of rotating inertia of the working pieces themselves is large. Further, as the rotating motions of the working pieces 203 are increased, the working pieces 203 also impart extremely complicated violent motions due to the collision of the working pieces 203 with one another, as well as the collision of the working pieces 203 with the interior walls of the container 201. Thus, the capacity for processing material, including crushing, mixing and stirring operations, is enhanced to a large extent.

Other examples of shapes of pieces of working, substance 203 are illustrated in FIGS. 19*a*, 19*b*, 20*a*, and 20*b*. Weighted portions 208 are provided at both ends of a working piece body proper in the shape of a long thin cylindrical substance. As a result, the mass of the working piece 203 is concentratedly distributed at its axial ends, whereby the working pieces impart considerably greater impact to the material for crushing during the process of rotating motions (described in connection with the basic exemplary embodiment of FIGS. 18*a* and 18*b*.

Although cylindrical working pieces, having a circular cross sectional shape have been shown in the examples, the same effect is, needless to say, obtained if substances having square or other cross sectional shapes are employed.

It will be appreciated by those skilled in the art that variations and modifications may be made without departing from the spirit of the inventive concepts disclosed herein. For example, it is noted that the present invention is also applicable to the mixing of liquids and powders as well as for polishing or deburring articles of manufacture, e.g., bolts, screws and the like. All such variations and modifications are intended to fall within the scope of the appended claims.

We claim:

1. A traveling magnetic field-type apparatus for processing loose material with working substances comprising:

an elongated container having two generally parallel opposed side surfaces and containing working substances and a quantity of loose material to be processed;

first traveling magnetic field generating means adjacent to one side surface of said container for generating a linearly traveling magnetic field; and second traveling magnetic field generating means adjacent to the other side surface of said container for generating a linearly traveling magnetic field;

wherein said first and second traveling magnetic field generating means generate corresponding magnetic fields at the opposite side surfaces of the container which travel in opposite linear directions with respect to each other and interact on the working substances within the container, thereby imparting random motion to said working susbtances to cause them to process the loose material throughout the container.

2. The traveling magnetic field-type apparatus according to claim 1, wherein said container and said first and second traveling magnetic field-type generating means are circular and concentrically arranged, and wherein said container is disposed between the first and second concentrically arranged traveling magnetic field generating means.

3. The traveling magnetic field-type apparatus according to claim 1, wherein said container and said first and second traveling magnetic field generating means each comprise a circular arc.

4. The traveling magnetic field-type apparatus according to any of claims 1, 2 or 3, wherein said container is provided with diaphragms.

5. The traveling magnetic field-type apparatus according to any of claims 1, 2 or 3, wherein the pole pitches of said first and second traveling magnetic field generating means are mutually different.

6. The traveling magnetic field-type apparatus according to any of claims 1, 2 or 3, wherein the strength of the magnetic fields of said first and second traveling magnetic field generating means is mutually different.

7. The traveling magnetic field-type apparatus according to any of claims 1, 2 or 3, wherein said working substances comprise conductive materials.

8. The traveling magnetic field-type apparatus according to any of claims 1, 2 or 3 wherein the distance between said first and second traveling magnetic field generating means is non-uniform.

9. The traveling magnetic field-type apparatus according to claim 8, wherein one of said first and second traveling magnetic field generating means comprises a flat plate, and the other of said traveling magnetic field generating means comprises a circular arc.

10. The traveling magnetic field-type apparatus according to claim 8, wherein both said first and second traveling magnetic field generating means comprise a circular arc.

11. The traveling magnetic field-type apparatus according to any of claims 1, 2, or 3, wherein said working substances are cylindrical-shaped so that their length in the axial direction exceeds their width as measured in the cross sectional direction, said working substances having a greater permeance coefficient in the axial direction.

12. The traveling magnetic field-type apparatus according to claim 11, wherein said working substances each comprise weighted portions at both of their axial ends.

* * * * *